US011435768B2

(12) United States Patent
Cui et al.

(10) Patent No.: US 11,435,768 B2
(45) Date of Patent: Sep. 6, 2022

(54) N-CHANNEL INPUT PAIR VOLTAGE REGULATOR WITH SOFT START AND CURRENT LIMITATION CIRCUITRY

(71) Applicant: STMicroelectronics (China) Investment Co. Ltd, Shanghai (CN)

(72) Inventors: Zhenghao Cui, Beijing (CN); Fei Wang, Shanghai (CN); Ming Jiang, Shanghai (CN)

(73) Assignee: STMicroelectronics (China) Investment Co. Ltd, Shanghai (CN)

( * ) Notice: Subject to any disclaimer, the term of this patent is extended or adjusted under 35 U.S.C. 154(b) by 125 days.

(21) Appl. No.: 16/941,918

(22) Filed: Jul. 29, 2020

(65) Prior Publication Data

US 2020/0356125 A1 Nov. 12, 2020

Related U.S. Application Data

(60) Division of application No. 16/451,601, filed on Jun. 25, 2019, now Pat. No. 10,761,551, which is a division of application No. 15/433,104, filed on Feb. 15, 2017, now Pat. No. 10,379,555, which is a (Continued)

(30) Foreign Application Priority Data

Dec. 29, 2014 (CN) ..... 201410856920.3

(51) Int. Cl.

| | |
|---|---|
| ***G05F 1/575*** | (2006.01) |
| ***G05F 1/45*** | (2006.01) |
| ***G05F 3/26*** | (2006.01) |

(52) U.S. Cl.
CPC ..... *G05F 1/575* (2013.01); *G05F 1/45* (2013.01); *G05F 3/26* (2013.01)

(58) Field of Classification Search
None
See application file for complete search history.

(56) References Cited

U.S. PATENT DOCUMENTS 7,719,243 B1 * 5/2010 Balogh ..... H02M 3/156 323/281
8,570,013 B2 * 10/2013 Lipcsei ..... G05F 1/56 323/282
2007/0194770 A1 8/2007 Kalyanaraman
(Continued)

FOREIGN PATENT DOCUMENTS

CN 101073196 A 11/2007

OTHER PUBLICATIONS

First Office Action and Search Report for co-pending CN Appl. No. 201410856920.3 dated Jan. 25, 2017 (7 pages).
(Continued)

*Primary Examiner* — Jeffrey A Gblende
(74) *Attorney, Agent, or Firm* — Crowe & Dunlevy

(57) ABSTRACT

A voltage regulator includes two input pairs of opposite type transistors, p-type and n-type, to provide a soft-start functionality for gradually increasing the voltage regulator's output voltage from zero, or a voltage below the thresholds of the n-type transistors, to an operational voltage. The voltage regulator operates in a soft-start mode during which a variable input voltage signal is ramped up to allow the output voltage to reach the operational voltage, and a normal-operation mode during which the operational voltage is maintained.

5 Claims, 3 Drawing Sheets

Related U.S. Application Data continuation of application No. 14/595,690, filed on Jan. 13, 2015, now Pat. No. 9,651,964.

(56) References Cited

U.S. PATENT DOCUMENTS

| | | | | |
|---|---|---|---|---|
| 2008/0143452 | A1 | 6/2008 | Rosik et al. | |
| 2008/0246450 | A1 | 10/2008 | Matyas et al. | |
| 2009/0189647 | A1 | 7/2009 | Easwaran et al. | |
| 2010/0052636 | A1* | 3/2010 | Takagi | G05F 1/56 323/281 |
| 2010/0164565 | A1 | 7/2010 | Takeuchi | |
| 2013/0176008 | A1* | 7/2013 | Li | H02M 3/1588 323/273 |
| 2015/0162830 | A1 | 6/2015 | Dong et al. | |
| 2015/0256060 | A1 | 9/2015 | Faingersh et al. | |
| 2015/0326106 | A1 | 11/2015 | Li | |

OTHER PUBLICATIONS

Solhusvik, Johannes, et al.: "A Comparison of High Dynamic Range CIS Technologies for Automotive Applications," OmniVision Technologies, 2013 (4 pages).

* cited by examiner

N-CHANNEL INPUT PAIR VOLTAGE REGULATOR WITH SOFT START AND CURRENT LIMITATION CIRCUITRY

CROSS REFERENCE TO RELATED APPLICATIONS

This application is a divisional of United States Application for patent application Ser. No. 16/451,601, filed Jun. 25, 2019, which is a divisional of U.S. application for patent application Ser. No. 15/433,104, filed Feb. 15, 2017, now U.S. Pat. No. 10,379,555, which is a continuation of U.S. application for patent application Ser. No. 14/595,690 filed Jan. 13, 2015, now U.S. Pat. No. 9,651,964, which claims priority from Chinese Application for Patent No. 201410856920.3 filed Dec. 29, 2014, the disclosures of which are incorporated by reference.

BACKGROUND

Voltage regulators provide stable nearly constant (regulated) supply voltage to a load in an attempt to maintain the regulated supply voltage at the nearly constant value regardless of the current demands of the load. Voltage regulators are used in complex electronic systems to regulate supply voltages before being supplied to other circuit components. One of the many issues circuit designers must evaluate is how a circuit design behaves when power is first applied. Unexpected things can happen at startup. Capacitors must be charged, and all integrated circuits (ICs) change from an inactive state to an active state. Frequently, several voltage regulators provide power to the same circuit, and each regulator output must be sequenced at startup. Controlling the slew rate of a voltage regulator's output voltage at startup lowers the stress on circuit components and allows circuit designers to adjust the startup voltage rate to what is required by the circuit.

Complex electronic systems often require voltage regulators that provide soft start control of a voltage supply. Soft-start circuitry controls supply voltages at startup so that they rise at a controlled slew rate to an operating voltage. Soft-start circuitry can control inrush currents in capacitors, minimize load surges, and reduce the chances that the voltage supply will overshoot the operating voltage. Soft-start circuitry may take many forms. One particular implementation uses an error amplifier comprising an input pair of n-channel transistors. N-type transistors make it difficult to implement soft-start functionality because the input voltage to the n-channel transistors cannot swing too low. The input range of an n-type input amplifier cannot be close to its ground rail, and the feedback loop of the regulator using n-type transistors is only effective when the output voltage exceeds a certain threshold voltage.

A specific type of voltage regulator, called a "track regulator," mirrors, or "tracks," the output voltage of another voltage supply. In other words, the track regulator produces a secondary voltage supply that follows the voltage of a primary voltage regulator output. Track regulators are useful to create a second voltage supply with the same supply voltage of another regulator. Soft-start functionality is needed during the startup of a track regulator to limit inrush current and overshoot voltage. But it is difficult to implement the soft start of a track regulator when the error amplifier of a track regulator uses n-channel transistors. Again, the input to n-channel transistors cannot swing too low or be close to a ground rail in order for the track regulator to work properly, because the feedback loop of a track regulator with n-type transistors is only effective when the regulator output voltage exceeds the gate-to-source voltage of the n-channel transistors.

SUMMARY

This Summary is provided to introduce a selection of concepts in a simplified form that are further described below in the Detailed Description. This Summary is not intended to identify key features or essential features of the claimed subject matter. Nor is it intended to specifically limit all embodiments to particular features.

One embodiment is directed toward a voltage regulator configured to operate in a soft-start mode and a normal-operation mode. The voltage regulator includes a soft-start circuit comprising at least one p-type transistor, and the soft-start circuit is configured to receive a variable ramp voltage signal and a soft-start feedback signal. The voltage regulator also includes an error amplifier comprising at least one n-type transistor for receiving a normal-operation feedback signal. Control logic is used to vary the variable ramp voltage signal and gradually increase the regulator output signal during a soft-start mode of operation while maintaining the regulator output signal during a normal-operation mode of operation.

In another embodiment, an output voltage signal of the voltage regulator is provided to a track voltage regulator configured to track the output signal of the voltage regulator. The track regulator may include a first operational amplifier (op-amp) with n-type transistor inputs with one receiving the output voltage signal and a second op-amp with p-type transistor inputs for receiving a second variable voltage signal and an internal feedback signal of the track regulator.

Another embodiment is directed to a voltage regulator for generating an output voltage signal and that is configured to operate in a soft-start mode and a normal-operation mode. The voltage regulator includes an amplifier comprising a pair of n-type transistors with a first n-type transistor configured to receive a first feedback signal that is based on the output voltage signal. The voltage regulator also includes a soft-start circuit comprising a pair of p-type transistors with a first p-type transistor configured to receive a variable ramp voltage signal and a second p-type transistor configured to receive a second feedback signal. Control logic is configured to vary the variable ramp voltage signal and consequently cause the output voltage signal to: (1) gradually increase from a starting voltage to an operational voltage during the soft-start mode, and (2) maintain the operational voltage during the normal-operation mode.

Another embodiment includes a second n-type transistor of the amplifier configured to receive a reference voltage input signal. This embodiment includes a voltage feedback circuit comprising a first resistor and a second resistor, and the control logic maintains the operational voltage during the normal-operation mode once the output voltage signal reaches a voltage level equal to a fraction of the reference voltage based on the first resistor and the second resistor. In another embodiment, the voltage level equals the reference voltage input signal multiplied by a sum of the first transistor and the second transistor divided by the second transistor.

Another embodiment is directed to a voltage regulator for generating an output voltage signal and configured to operate in a soft-start mode and a normal-operation mode. In this embodiment, the voltage regulator includes a first operational amplifier comprising a pair of n-type transistors and configured to receive a feedback signal that is based on the output voltage signal. The track regulator also includes a second operational amplifier comprising a pair of p-type transistors with a first p-type transistor configured to receive a variable ramp voltage signal and a second p-type transistor configured to receive a soft-start feedback signal. Control logic is configured to vary the variable ramp voltage signal and consequently cause the output voltage signal to gradually increase from a starting voltage to an operational voltage during the soft-start mode.

BRIEF DESCRIPTION OF THE DRAWINGS

The present invention is described in detail below with reference to the accompanying drawing figures, wherein.

DETAILED DESCRIPTION

The subject matter of the present invention is described with specificity herein to meet statutory requirements. But the description itself is not intended to limit the scope of this patent. In fact, the claimed subject matter might also be embodied in other ways or include different steps or combinations of steps similar to the ones described in this document in conjunction with other present or future technologies.

The terms "coupled," "connected," and "substantially," which are utilized herein, are defined as follows. The term "connected" is used to describe a direct connection between two circuit elements, for example, by way of a metal line formed in accordance with normal integrated circuit fabrication techniques. In contrast, the term "coupled" is used to describe either a direct connection or an indirect connection between two circuit elements. For example, two coupled elements may be directly connected by way of a metal line, or indirectly connected by way of an intervening circuit element (e.g., a capacitor, resistor, inductor, or transistor). The term "substantially" is defined herein as a range of values within ten percent of a quantified value.

Figure 1:
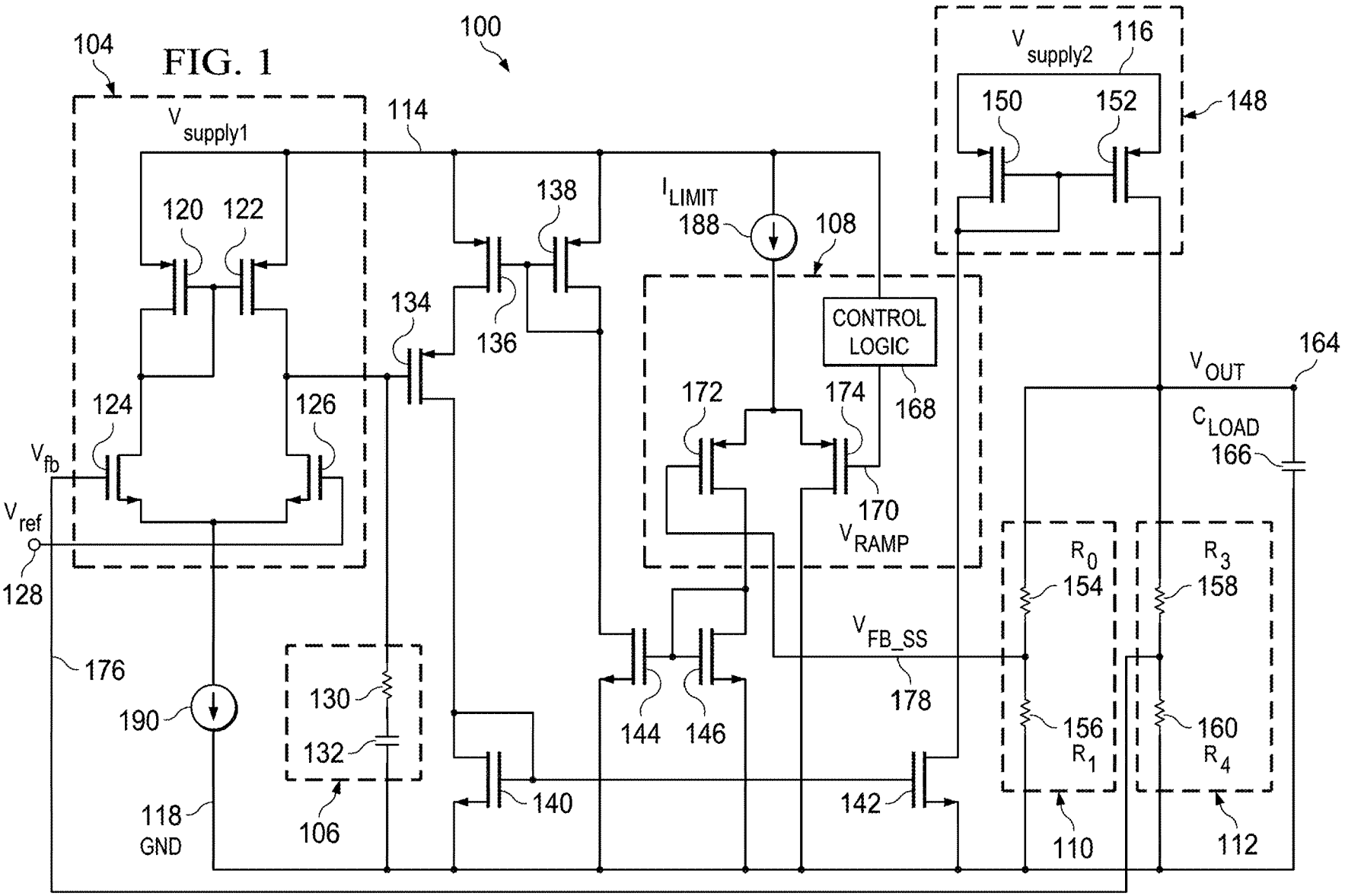
FIG. 1 is a schematic diagram of a voltage regulator with a soft-start circuit in accordance with one embodiment.

FIG. 1 is a schematic diagram of a voltage regulator 100 with a pair of n-type input transistors 124 and 126 and circuitry for performing soft-start voltage ramp-up, according to one embodiment. Voltage regulator 100 includes an error amplifier 104, compensation circuit 106, soft-start circuit 108, soft-start feedback circuit 110, and normal-operation feedback circuit 112. These circuits are electrically coupled to voltage supply rails Vsupply1 114 and Vsupply2 116, which represent different voltage supplies, and are grounded to ground (GND) rail 118. A variable ramp supply voltage (Vramp) 170, which is described in more detail below, is created from Vsupply1 114 by control logic 168 to provide the voltage regulator 100 with soft-start functionality.

Error amplifier 104 includes two p-type transistors 120 and 122 and two input n-type transistors 124 and 126, and it receives Vsupply1 114, a reference voltage (Vref) 128, and current from current source (Itail) 190. Soft-start circuitry 108 includes two p-type transistors 172 and 174. Driver circuit 148 includes two n-type transistors 150 and 152. Soft-start feedback circuit 110 and normal-operation feedback circuit 112 include resistors $R_0$ 154, $R_1$ 156, $R_3$ 158, and $R_4$ 160, as shown in FIG. 1. Compensation circuit 106 includes a compensation resistor 130 and capacitor 132 to stabilize the output of the error amplifier 104.

The output of the error amplifier 104 is connected to the compensation circuit 106 and to the gate of transistor 134. Transistors 136, 138, 140, 142, 144, 146, 150, and 152 act as current mirrors to sink or source current to and from the error amplifier 104, the soft-start circuit 108, and a driver circuit 148. Driver circuit 148 receives a second external voltage supply (Vsupply2) 116 and is connected to the two feedback circuits: soft-start feedback circuit 110 and normal-operation feedback circuit 112.

Input n-type transistors 124 and 126 represent an n-channel input pair of transistors of error amplifier 104 that respectively receive a feedback signal (Vfb) 176 and Vref 128 at their corresponding gates. In one embodiment, Vref 128 is a voltage that is based on—either mirrored or a division of—Vsupply1 114. As previously discussed, use of an n-channel input transistor pair makes it difficult to implement soft-start functionality because the n-channel transistors 124 and 126 will not forward-bias when the voltage at their gates are very low, which is the condition, generally, at start-up.

Transistor 172 receives a feedback voltage signal (Vfb_ss) 178 at its gate, and the gate of transistor 174 receives Vramp 170 from control logic 168. Ilimit 188 is electrically coupled to the sources of transistors 172 and 174. Transistor 174 is directly tied to GND 118, and transistor 172 has an intervening current mirror transistor 146.

Vref 128 is supplied to transistor 126 of the error amplifier 104. The n-type transistors 124 and 126 are only turned on when Vref 128 and Vfb 176 exceed the threshold gate-to-source (Vgs) voltage of transistors 126 and 124, respectively. The p-type transistors 120 and 122 are arranged in a current-mirror configuration, mirroring the current from transistor 120 to transistor 122. In operation, the current of Itail 190 flows to transistors 124 and 126, and the current of transistor 124 is mirrored to transistor 122 through transistor 120. The gate voltage of transistor 134 is controlled by the current difference of transistors 126 and 122.

Normal-operation feedback circuit 112 generates Vfb 176 for the error amplifier 104, and soft-start feedback circuit 110 generates feedback signal Vfb_ss 178 for the soft-start circuit 108. These circuits divide the voltage of Vout 164 from transistor 152 using resistors $R_0$ 154/$R_1$ 156 for soft-start feedback circuit 110 and $R_3$ 158/$R_4$ 160 for normal-operation circuit 112. Additional resistors may be used to create a specific voltage division. In an alternative embodiment, the ratios of $R_0$ 154 divided by $R_1$ 156 (ratio 1) and $R_3$ 158 divided by $R_4$ 160 (ratio 2) are the same, and feedback signals 178 and 176 are combined into one feedback signal. In such an alternative embodiment, $R_0$ 154 and $R_3$ 158 may combine into one resistor, and $R_1$ 156 and $R_4$ 160 may combine into one resistor.

In operation, voltage regulator 100 functions in one of two modes: (1) soft-start mode, and (2) normal-operation mode. In soft-start mode, the supply voltages Vsupply1 114 and Vsupply2 116 are initially off, and the voltage regulator 100 is not generating an output voltage Vout 164. When Vsupply1 114 and Vsupply2 116 are initially turned on, the voltage regulator 100 enters the soft-start mode of operation during which control logic 168 begins gradually increasing Vramp 170, which is supplied to transistor 174, from 0 to Vsupply1 114. Initially, all of the current from current source Ilimit 188 flows to transistor 174, but as Vramp 170 is ramped up, transistor 172 begins to draw more and more current. In effect, the increase of Vramp 170 gradually increases the voltage and current in the driver circuit 148, or, more specifically, the voltage and current provided out of transistor 152 as Vout 164.

During soft-start mode, Vout 164 is controlled by a feedback loop comprising transistors 172, 174, 144, 146, 138, 136, 134, 140, 142, 150, and 152 and resistors $R_0$ 154 and $R_1$ 156. Vramp 170 is supplied to p-type transistor 174 of the soft-start circuit 108. Control logic 168 gradually increases Vramp 170 from 0V—or a voltage less than the threshold voltage of transistor 174—to Vsupply1. In the soft-start mode, the voltage of Vout 164 is 0V, or some other lower non-operating voltage of the voltage regulator 100 normal operating voltage, and because Vout 164 is low, the voltage of Vfb 176 is consequently lower than Vref 128, which causes the majority of the current from Itail 190 to flow to transistor 126 with little current flowing to transistor 124. The current of transistor 124 passes to transistor 120, and is then mirrored to transistor 122. Again, the current of transistor 126 is much larger than the current of transistor 124, and this larger current is mirrored through transistor 120 to transistor 122. Consequently, the gate voltage of p-type transistor 134 is driven lower by the current of transistor 126 during the soft-start mode, resulting in the transistor 134 being turned on.

For the sake of clarity, Vramp 170 is discussed herein as being increased "gradually," which refers to the fact that the voltage of Vramp 170 may be increased linearly in some embodiments, stepped-up (i.e., increased to an interim voltage, held at that voltage for a period of time, increased to a second interim voltage, and so forth), or increased in a non-linear or parabolic fashion.

As Vramp 170 reaches Vsupply1 114 during soft-start mode, all of Ilimit 188 will flow through transistor 172 and pass through the current mirrors of transistors 146, 144, 138, and 136. In this case, all of the current of Ilimit 188 will reach transistor 134, and the current passing through transistor 134 will be limited by the current Ilimit 188. Therefore, the maximum output current of the regulator 100 is capped by Ilimit 188 and the mirroring ratios of the current mirrors consisting of transistors 146, 144, 138, 136, 140, 142, 150, and 152. This ensures that the voltage regulator never exceeds a certain current threshold, and thus protecting against current surges and spikes. Moreover, Vout 164 is controlled by a low gain loop made up of transistors 174, 172, 146, 144, 138, 136, 140, 142, 150, 152, $R_0$ 154, and $R_1$ 156. The low gain loop is compensated by Cload 166, and no additional compensation circuit is needed.

Transistor 134 is a p-type transistor that turns on when it receives a low voltage at its gate from the error amplifier 104. During soft-start mode, transistor 134 is completely turned on due to the low or zero voltage coming out of the error amplifier 104. Transistors 146, 144, 168, 136, 140, 142, 150, and 152 mirror the current of transistor 172 to Vout 164. As the voltage from the error amplifier 104 increases, transistor 134 begins reducing the amount of current and voltage originating from the soft-start circuit 108 that is provided to Vout 164. In one embodiment, soft-start feedback voltage Vfb_ss 178 follows the voltage of Vramp 170 by a ratio of $(R_0+R_1)/R_1$ until Vout 174 reaches $Vref*(R_3+R_4)/R_4$. In one embodiment, when Vramp 170 is greater than the voltage of $Vref*(R_3+R_4)R_4/((R_0+R_1)/R_1)$, the voltage regulator 100 transitions from the soft-start mode to the normal-operation mode, Vramp 170 is no longer increased, and Vout 164 correspondingly reaches $Vref*(R_3+R_4)/R_4$, where it is maintained during the normal-operation mode. In another embodiment, voltage regulator 100 transitions to the normal-operation mode, keeping Vout 164 locked, when Vramp 170 reaches Vsupply1 114.

During normal-operation mode, Vout 164 is controlled by a feedback loop comprising transistors 120, 122, 124, 126, 134, 140, 142, 150, and 152; compensation circuit 106; and resistors R3 158 and R4 160. In normal-operation mode, Vfb 176 and Vref are greater than the threshold voltages for transistors 124 and 126, respectively, so both transistors are turned on, and the output signal from transistor 142 is transferred through transistors 150 and 152 to Vout 164. Normal-operation feedback circuit 112 contains a voltage divider that provides Vfb 176 a division or fraction of Vout 164, back to input transistor 124 of the error amplifier 104.

Control logic 168 may include various additional circuitry for ramping Vramp 170 to Vsupply1 114, and in some embodiments, may be driven by executable instructions embodied on storage media, or memory, that are executable by a processor or controller to cause variable voltage Vramp 170 to gradually increase to Vsupply1 114. In one embodiment, control logic 168 is programmed to gradually increase Vramp 170 being supplied to the gate of transistor 174 from 0V to Vsupply1 114 within a specific timeframe during which the voltage regulator 100 operates in the soft-start mode. For example, the control logic 168 may increase Vramp 170 from 0 to 6V in six milliseconds. After the timeframe, the voltage regulator transitions out of the soft-start mode and into the normal-operation mode during which Vramp 170 is kept at Vsupply1 114.

Figure 2:
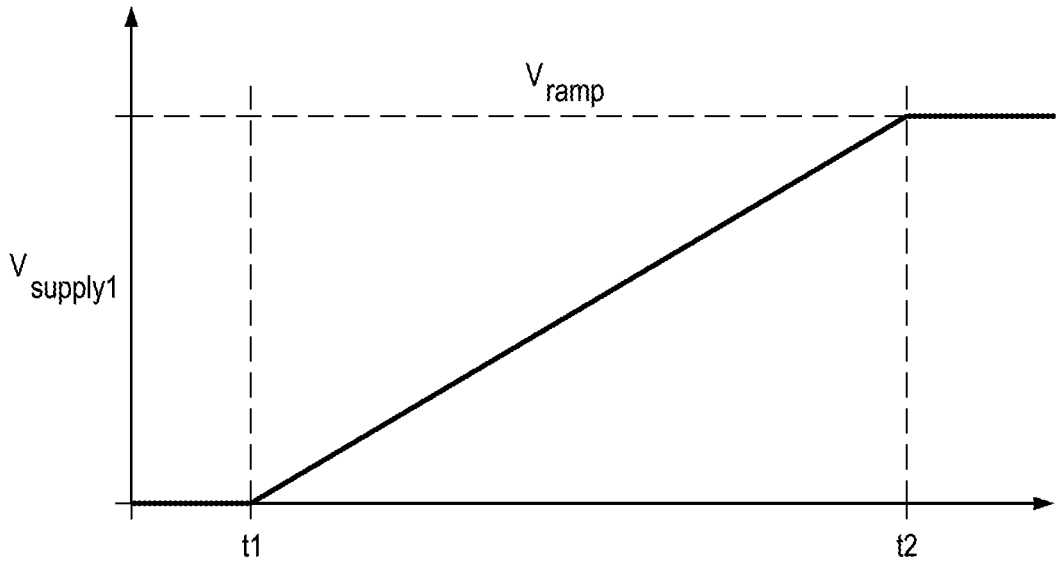
FIG. 2 is a diagram of a graph illustrating the a ramp voltage being applied to a voltage regulator with a soft-start circuit in accordance with one embodiment.

FIG. 2 illustrates a graph showing Vramp 170 linearly increasing from 0V at a first time (t1) to Vsupply1 114 at a second time (t2). The linear rise of Vramp 170 is ideal for several soft-start operations, but, again, not all embodiments will increase Vramp 170 in a linear fashion. Some may apply a parabolic or staggered increase in Vramp 170 from 0 V to Vsupply1 114. Also, the chart shows Vramp 170 being equal to 0V at t1. In some embodiments, voltage ramping may begin at t1 when Vramp 170 is between 0V and the threshold voltage for transistor 174.

In an alternative embodiment, Vramp 170 may be gradually increased at a particular "voltage ramp rate," meaning a particular voltage step-up rate, until Vramp 170 reaches Vsupply1 114. Thus, in such an embodiment, no ramp timeframe is required. Embodiments may use a voltage sensor to detect when Vramp 170 reaches the Vsupply1 114, and thereafter, the control logic 168 may then maintain the Vramp 170 at Vsupply1 114 as the voltage regulator 100 transitions from the soft-start mode to the normal-operation mode.

Figure 3:
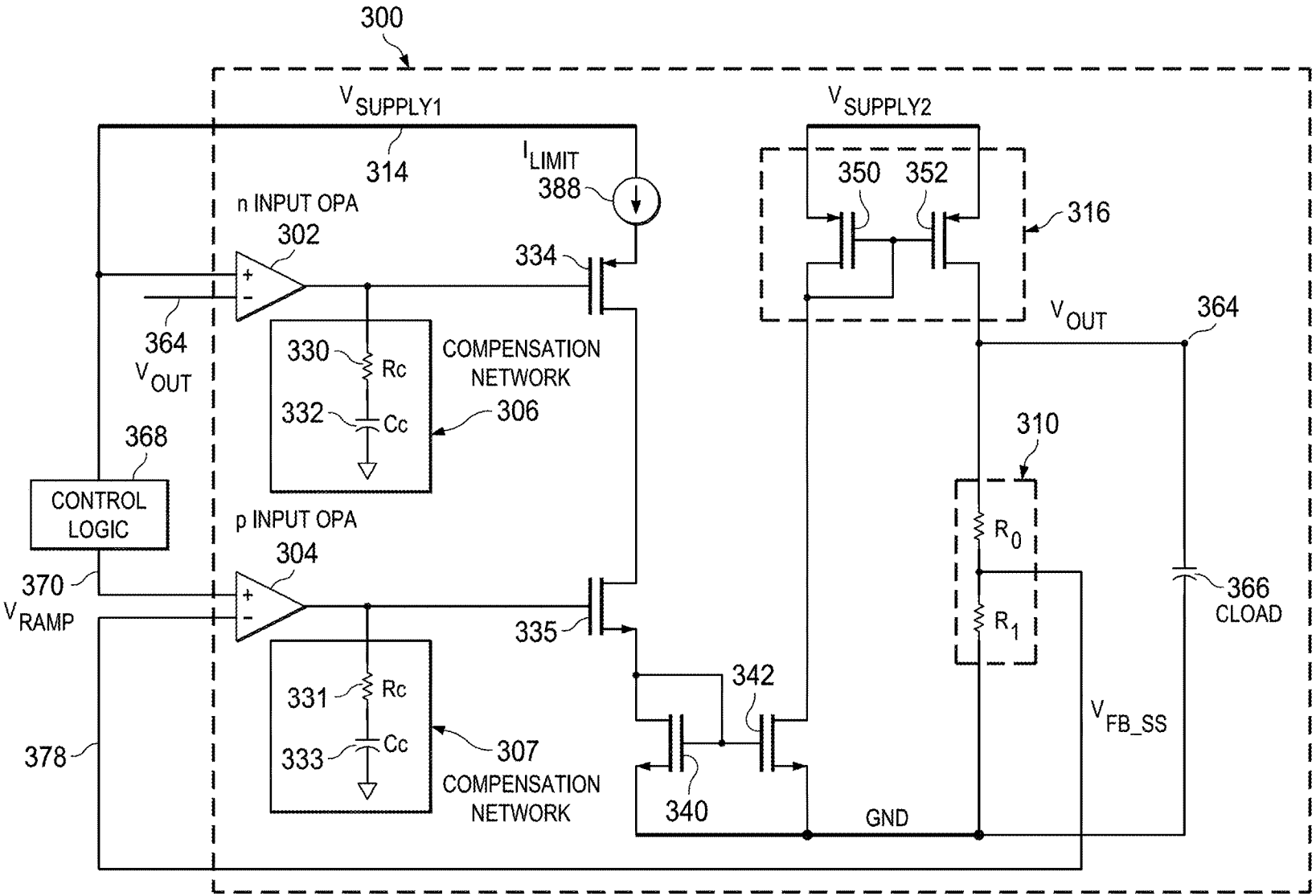
FIG. 3 is a schematic diagram of a track voltage regulator with a soft-start circuit in accordance with one embodiment.

FIG. 3 is a schematic diagram of track regulator 300, according to one embodiment. Track regulator 300 is a voltage regulator that mirrors a reference voltage, shown as Vsupply1 314, and includes circuitry for providing a soft start function to gradually increase the output voltage Vout 364 of track regulator 300 from 0V, or a low value, to Vsupply1 314. Vsupply1 314 may be the voltage of another voltage regulator, e.g., voltage regulator 100 discussed above in FIG. 1.

Control logic 368 may include various additional circuitry for ramping Vramp 370 to Vsupply1 314, and in some embodiments, may be driven by executable instructions embodied on storage media, or memory, that are executable by a processor or controller to cause variable voltage Vramp 370 to gradually increase to Vsupply1 314 or some other operational voltage level.

In the illustrated embodiment, track regulator 300 includes two operational amplifiers (op-amps) 302 and 304 with opposite input transistor pair types. Op-amp 302 has n-type transistors on its inputs that receive Vsupply1 314 at the non-inverting input and Vout 364 at the inverting input. Vsupply1 314 is supplied directly to the non-inverting input of op-amp 302, and Vramp 370, which is based on Vsupply1 314, is provided to the non-inverting input of op-amp 304. Vramp 370 is a variable voltage that is gradually increased from 0V to Vsupply1 314 by control logic 368. Op-amp 304 also receives soft start feedback signal Vfb_ss 378 at the inverting input.

The different types of input transistors (n- and p-type), though not explicitly shown (see, similar circuitry in FIG. 1), provide different functional input ranges to op-amps 302 and 304. The n-type transistors of op-amp 302 are only operational when Vsupply1 314 and Vout 364 both exceed the threshold gate-to-source voltage (Vgs) of the n-type transistors of op-amp 302. Conversely, op-amp 304 uses p-type transistors that are at low voltages from Vramp 370 and a feedback signal Vfb_ss 378 supplied from voltage divider 310.

Compensation network 306 compensates the output of op-amp 302 using resistor Rc 330 and capacitor Cc 332, and similarly, compensation network 307 compensates the output of op-amp 304 using resistor Rc 331 and capacitor Cc 333. Compensation networks 306 and 307 provide, in various embodiments, dominant-pole or lag compensation, or otherwise stabilize the outputs of the op-amps 302 and 304.

In operation, track regulator 300 functions in one of two modes: (1) soft-start mode, and (2) normal-operation mode. In the soft-start mode, op-amp 304 controls an output voltage Vout 364 of the track regulator 300, and control logic 368 gradually increases Vramp 317 from 0V, or a relatively low voltage, to Vsupply1 314. At such low voltages (i.e., voltages lower than the gate-to-source voltages of the n-type transistors of op-amp 302), the p-type transistors of op-amp 304 are functional, transistor 335 is turned on, and transistor 334 is kept off. Vramp 370 is provided through the current mirrors of transistors 335, 340, 342, 350, and 352 to Vout 364, and Vout 364 is fed back to the inverting input of op-amp 302.

Taking a closer look, when the track regulator is first enabled during soft-start mode, Vout 364 equals 0V and is supplied to the inverting input of op-amp 302. But the non-inverting input of op-amp 302 is tied to Vsupply1 314, and the difference between the two inputs makes op-amp 302 unbalanced, thereby turning on transistor 334. During the soft-start mode, Vout 364 is controlled by the negative feedback loop of the p-type transistor op-amp 304, and the control logic 368 gradually increases Vramp 368 supplied to the non-inverting input of op-amp 304 from 0V to Vsupply1 314. The compensated output of op-amp 304 is provided to transistor 335, which is turned on once its threshold gate-to-source voltage is met. Transistors 340 and 342 mirror the current from the drain of transistor 335 to a driver circuit 316, which receives a second voltage supply Vsupply2 and generates Vout 364 equal to the output provided by transistor 335.

Once Vramp 370 reaches Vsupply1 314, control logic 368 stops increasing Vramp 370 and maintains Vramp 370 at Vsupply1 314. The track regulator 300 transitions from the soft-start mode to the normal-operation mode of operation. In the normal-operation mode, op-amps 302 and 304 are both functional, so transistors 334 and 335 are both turned on. Thus, Vout 364 of track regulator 300 is ramped from 0V to Vsupply1 314 in soft-start mode, and then maintained at Vsupply1 314 during normal-operation mode. This provides an effective way to implement soft start functionality while eliminating inrush current and overshoot voltage during startup.

Vout 364 is fed back to the inverting input of op-amp 302 and used by voltage divider 310 to generate Vfb_ss 378. Voltage divider 310 produces Vfb_ss 378 as a function of Vramp 370 by a ratio of (R0+R1)/R1 until Vout 364 reaches the voltage of Vsupply1 314. After that, the track regulator 300 switches from the soft-start mode to the normal-operation mode, resulting in the inputs of the op-amp 304 being unbalanced, transistor 335 turning on, and Vout 364 tracking Vsupply1 314. The capacitance experienced at Vout 364 is illustrated as Cload 366.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

The invention claimed is:

1. A method for operating a voltage regulator to generate an output voltage signal, comprising:

sourcing an output current to generate the output voltage signal;

operating in a soft-start mode comprising:

varying a variable ramp voltage signal to gradually increase from a starting voltage to an operational voltage during the soft-start mode;

determining a first difference between a first feedback signal that is based on the output voltage signal and the variable ramp voltage signal;

generating a soft start current in response to said first difference; and mirroring the soft start current to produce said output current; and operating in a normal-operation mode comprising:

maintaining the operational voltage during the normal-operation mode;

determining a second difference between a second feedback signal that is based on the output voltage signal and a reference signal; and controlling mirroring of the soft-start current in response to the second difference to produce said output current.

2. The method of claim 1, further comprising generating the first feedback signal by voltage dividing the output voltage signal.

3. The method of claim 1, further comprising generating the second feedback signal by voltage dividing the output voltage signal.

4. The method of claim 1, further comprising controlling said variable ramp voltage signal to:

increase in voltage during the soft-start mode; and remain at a fixed voltage during a normal-operation mode following said soft-start mode.

5. The method of claim 4, wherein the fixed voltage is a supply voltage for the voltage regulator.

* * * * *